US006754997B2

(12) United States Patent
Bonin

(10) Patent No.: US 6,754,997 B2
(45) Date of Patent: Jun. 29, 2004

(54) UTILITY DISTRIBUTION STRUCTURE

(76) Inventor: Pete J. Bonin, 8816 Yuba Cir., #1110-C, Huntington Beach, CA (US) 92646

( * ) Notice: Subject to any disclaimer, the term of this patent is extended or adjusted under 35 U.S.C. 154(b) by 0 days.

(21) Appl. No.: 10/176,573

(22) Filed: Jun. 21, 2002

(65) Prior Publication Data

US 2003/0084627 A1 May 8, 2003

Related U.S. Application Data

(60) Provisional application No. 60/337,944, filed on Nov. 8, 2001.

(51) Int. Cl.[7] ..... E04C 2/52

(52) U.S. Cl. ..... 52/220.1; 52/198; 52/202; 52/220.3; 52/302.1; 52/302.3

(58) Field of Search ..... 52/302.1, 202, 52/218, 220.1, 220.3, 79.9, 198, 302.3, 793.1; 454/241, 243, 245, 246, 271

(56) References Cited

U.S. PATENT DOCUMENTS

| | | | | |
|---|---|---|---|---|
| 343,289 A | | 6/1886 | Wing | |
| 1,131,437 A | | 3/1915 | Stockmann | |
| 1,633,032 A | | 6/1927 | Nording | |
| 2,487,287 A | | 11/1949 | Weber et al. | |
| 2,664,809 A | * | 1/1954 | Morell | 454/271 |
| 2,789,493 A | * | 4/1957 | Riggle | 454/196 |
| 3,303,770 A | | 2/1967 | Anthony | |
| 4,216,823 A | | 8/1980 | Keldmann | |
| 4,295,415 A | * | 10/1981 | Schneider, Jr. | 454/185 |
| 4,373,576 A | | 2/1983 | Strupczewski | |
| 4,535,684 A | | 8/1985 | Perng | |
| 4,573,292 A | * | 3/1986 | Kaufman et al. | 52/79.1 |
| 4,580,487 A | | 4/1986 | Sosnowski | |
| 4,658,552 A | * | 4/1987 | Mulford | 52/94 |
| 4,916,871 A | * | 4/1990 | Anderson | 52/98 |
| 5,561,958 A | * | 10/1996 | Clement et al. | 52/407.1 |
| 5,761,864 A | | 6/1998 | Nonoshita | |
| 5,826,390 A | * | 10/1998 | Sacks | 52/408 |

* cited by examiner

*Primary Examiner*—Jeanette Chapman
(74) *Attorney, Agent, or Firm*—Gene Scott-Patent Law & Venture Group

(57) ABSTRACT

A utility distribution apparatus comprises an inner wall removably mounted on an outer wall within a building structure. The inner and outer walls create a chase for air flow. A floor surface forms a generally closed corner with the outer wall. The inner wall is spaced apart from, and above the floor. One or more horizontally oriented utility conduits are supported from the floor surface or the outer wall and are positioned below the chase. A utility cover is fixed to the inner wall and extends to the floor surface for hiding the utility conduits. A lower and an upper apertures in the outer wall are positioned for receiving and expelling an air flow through the chase.

13 Claims, 2 Drawing Sheets

UTILITY DISTRIBUTION STRUCTURE

PRIORITY CLAIM

This application claims the priority date of prior filed provisional application, serial No. 60/337,944 and filing date, Nov. 8, 2001.

BACKGROUND OF THE INVENTION

INCORPORATION BY REFERENCE

Applicant(s) hereby incorporate herein by reference, any and all U.S. patents, U.S. patent applications, and other documents and printed matter cited or referred to in this application.

1. Field of the Invention

This invention relates generally to utility installations in existing buildings and more particularly to an easily installed wall mounted system enabled for providing utilities to buildings.

2. Description of Related Art

The following art defines the present state of this field:

Wing, U.S. Pat. No. 343,289 describes a ventilating apparatus for buildings, the combination, with an exhaust-flue, provided with a fan, or other exhaust apparatus, of a ventilating flue, arranged between the floor and ceiling to communicate directly with the exhaust-flue and communicate with, an apartment above and below it through openings which are distributed throughout the floor and ceiling, substantially as and for the purpose described.

Stockmann, U.S. Pat. No. 1,131,437 describes a building block comprising outer and inner slabs that extend longitudinally throughout the length of the block, each of said slabs being provided on its upper edge with a rabbet that extends the entire length of said slab, and having its lower edge reduced in thickness so as to fit in the rabbet of an adjacent block, a plurality of longitudinal partitions arranged intermediate said outer and inner slabs, the upper edge of each of said partitions being flush with the upper edge of said outer and inner slabs, and the lower edge lying in a higher horizontal plane than the lower edges of said slabs, and a plurality of transversely extending tie members that integrally connect said partitions, said tie members being inwardly removed from the end portions of the block and having their lower edges lying in a higher horizontal plane than the lower edges of said partition members.

Nordling, U.S. Pat. No. 1,633,032 describes a base board radiator, comprising a casing adapted to be secured to a wall containing a plurality of heat conveying pipes and having a back plate and a front plate removably secured thereto and a crown moulding secured to the upper end thereof that will give the front plate of said radiator the appearance of a base board; tubes between the back plate of said casing and its front base board late, said front plate being being provide with screw receiving apertures and screws extending loosely through said apertures and each of said tubes and also extending through the back plate of said casing and screwed into said wall whereby said front plate is clamped to said casing and said casing is clamped to said wall, said front plate being provided with grooves over the ends of said tubes, said screw receiving apertures in the grooves of said plate, provided with oblong holes on their opposite sides and a turnbutton having wings mounted on each of said screws; the % vings of said turn-button being narrower than the oblong holes through said plate whereby when said screws are turned to clamp the front plate to said tubes the wings of said turn-buttons are turned at right angles to the oblong slots in said plate, but when it is desired to remove said plate without removing said screws from said wall, said turn-button is turned until its wings register in the oblong holes of said plate in said groove.

Weber et al., U.S. Pat. No. 2,487,287 describes a baseboard structure for concealing a conduit for heat exchange fluid extending along the region of the baseboard of a room, comprising a series of elongated panels each shaped to simulate a section of the face portion of a baseboard, the upper edges of said panels being bent over rearwardiy to form a beaded edge along the top substantially at the plane of said face portion and including a downwardly directed hook-like channel, bracket means at spaced points concealed to the rear of said panels for supporting said panels in spaced relation to the wall and floor, to provide an open slot between the lower edge of the panels and the floor for admission of air to the rear of the panels and an open slot along the top at the rear of said beaded edge for the escape of air, said bracket means having upwardly directed portions adapted to be engaged by said hook-like channel, said panels also being formed with inturned lower edges and said brackets being formed with downwardly directed portions over which said inturned lower edges are adapted to removably snap into eXagement after hooking the top edges of the panels in place.

Anthony, U.S. Pat. No. 3,303,770 describes a floor system, a wall system, and a ceiling system, said systems being combined to form an enclosure having a floor unit, a ceiling unit, and at least two side wall units and two end wall units, said wall units comprising the wall system, said floor unit comprising the floor system, said ceiling unit comprising the ceiling system a plurality of elongated chambers extending completely through said floor and ceiling units from one side wall unit to the other side wall unit, each side wall unit having a plurality of elongated chambers extending therethrough and communicating at one end with the floor chambers and at the other end with the ceiling chambers, thereby forming a plurality of passages surrounding said enclosure, and means for inducing a forced flow of air through each passage, said means for inducing a forced flow of air through each passage inducing the flow in opposite directions in adjacent passages.

Keldmann, U.S. Pat. No. 4,216,823 describes a heat apparatus for heating rooms in buildings and acting as baseboard in the rooms, where the heat is transmitted from a gaseous or liquid heating medium, such as steam or hot water, which passes channels in the housing of the apparatus. The housing comprises a housing portion which is a profile rail of metal, preferably a metal alloy with great heat conductivity, such as an aluminium alloy, and the profile rail is formed with integral, longitudinally extending, inner beads having hollow spaces for the heating medium, whereby the housing portion containing the heating medium channels can be manufactured in one operation by extrusion.

Strupczewski, U.S. Pat. No. 4,373,576 describes an air supply and return system for heating and cooling a room, including an air flow loop having a first set of openings positioned high in a wall of the room (high vents) and a second set of openings positioned low in a wall of the room (low vents). The air flow loop includes a reversible air moving device, heating and cooling coils, and ducts connecting the reversible air moving device, filters, and the heating and cooling coils to the high vents and the low vents. During the cooling cycle, air is withdrawn from the room through the low vents, circulated with high air flow by the air mover through the ducts, filter, and the cooling coils, and discharged to the room from the high vents. During the heating cycle the air mover, and thereby the direction of air flow within the duct system, is reversed. Heating operation is in two stages: a passive heating stage with low air flow during which warm, stratified air from the upper portion of the room is withdrawn therefrom through the high vents and circulated unheated through the duct system and discharged to the lower part of the room through the low vents, thereby minimizing stratification within the room; and an active heating stage with higher air flow during which the air withdrawn from the room through the high vents is heated and returned to the room through the low vents.

Perng, U.S. Pat. No. 4,535,684 describes a ventilation system for an enclosed occupied space, such as house, school, large building, etc., comprising a fresh air inlet and a fresh air passage provided at the lower side of vertical hollow walls, the fresh air passage having a plurality of fresh air outlet for supplying fresh air into the space, a plurality of exhaust air inlets provided on the ceiling of the space, a first exhaust air discharge passage communicated with the exhaust air inlets and lies in the ceiling, a second exhaust air discharge passage communicated with the first discharge passage and lies in a vertical wall, and an exhaust air outlet at the top of the second exhaust air passage.

Sosnowski, U.S. Pat. No. 4,580,487 describes a low energy demand structure with side walls, roof, and foundation wherein the side walls have inner and outer structures, the outer structure of frame construction with very heavy insulation substantially filling the outer structure. The inner surface of the outer wall structure is provided with a panel cover to hold the insulation in place and over the panel a moisture impermeable seal is placed. The inner wall structure is of vertical frame construction and provides circulating air passages and a finish interior surface. The ceiling is of similar structure with the circulating air passages of the ceiling and walls in communication with each other. The upper portion of the structure rests on foundation walls which extend at least 3–4' below the frost line and which are faced with rigid foam insulation also extending 3–4' below the frost line. A lowermost floor slab of concrete, which is usually the basement floor, has circulating air passage formed therein which are in communication with the air passages of the side walls or inner basement walls which, if present, are of hollow construction with air passages therein and the inner and outer basement walls are separated by a moisture impermeable vinyl sheeting and similar sheeting is placed between the floor slab and the underlying earth mass.

Nonoshita, U.S. Pat. No. 5,761,864 describes a building comprising an exterior wall having an outer air convection layer provided therein with an lower opening communicating with an atmosphere and an upper opening communicating with an atmosphere and an inner air convection layer provided therein with a lower opening communicating with an atmosphere and an upper opening communicating with a garret space, which in turn communicates through a ridge venting hood with an atmosphere.

The prior art teaches thermally insulated building panels, ventilation systems, buildings with internal air passages, molded wall and column structures, radiator enclosures, baseboard radiators, baseboard heating conduits mounted on carriers, HVAC systems, and structures with low energy demands; but does not teach a wall system easily installed into an existing building for HVAC and related purposes. The present invention fulfills these needs and provides further related advantages as described in the following summary.

SUMMARY OF THE INVENTION

The present invention teaches certain benefits in construction and use which give rise to the objectives described below.

A utility distribution apparatus comprises an inner wall removably mounted on an outer wall within a building structure. The inner and outer walls create a chase for air flow. A floor surface forms a generally closed corner with the outer wall. The inner wall is spaced apart from, and above the floor. One or more horizontally oriented utility conduits are supported from the floor surface or the outer wall and are positioned below the chase. A utility cover is fixed to the inner wall and extends to the floor surface for hiding the utility conduits. A lower and an upper apertures in the outer wall are positioned for receiving and expelling an air flow through the chase. In an alternate embodiment, the utility conduits run within the chase and the inner wall extends to the floor surface.

A primary objective of the present invention is to provide an apparatus and method of use of such apparatus that provides advantages not taught by the prior art.

Another objective is to provide such an invention capable of cooling or heating a room.

A further objective is to provide such an invention capable of conducting utility flows in a room not originally having such capacity.

A still further objective is to provide such an invention capable of inexpensive installation and removal.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above described drawing figures illustrate the invention in at least one of its preferred embodiments, which is further defined in detail in the following description.

Figure 1:
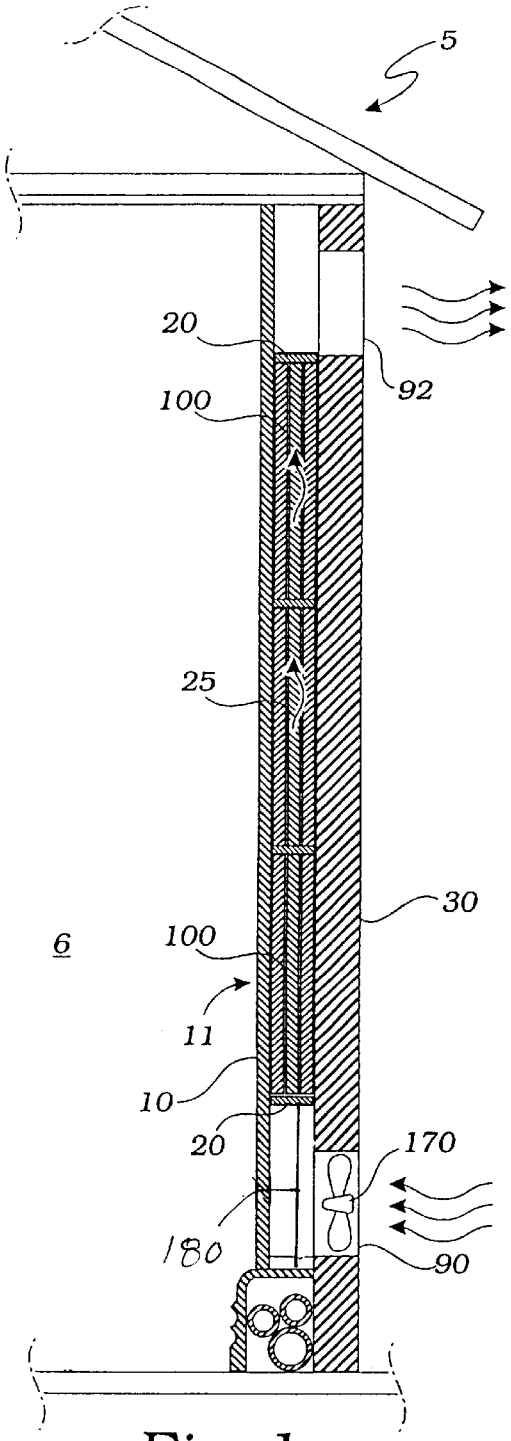
FIG. 1 is a sectional view of a first preferred embodiment of the invention.

The present invention, in a first embodiment shown in FIG. 1, is a utility distribution apparatus comprising in combination; a movable inner wall 10, such as may be made from the building material known as wall-board, or an equivalent material, is removably mounted by a means for hanging 20 from a fixed outer wall 30 within a building structure 5, that is, the inner wall 10 is mounted on an inside face 32 of the outer wall 30. The inner and outer walls 10, 30, as mounted and positioned, create a chase, or sandwiched space, 40 for enabling an air flow 25 between the walls 10, 30. A floor surface 50 is positioned below the walls 10, 30 and forms a generally closed corner 60 with the outer wall 30. The inner wall 10 is spaced apart from, and positioned above the floor surface 50 which yields access to the closed corner 60. One, and preferably several, horizontally oriented utility conduits 70 are supported by either the floor surface 50 or the outer wall 30, or both, and are positioned below the chase 40, adjacent to the outer wall 30 in the closed corner 60. A utility cover 80 is fixed to the inner wall 10 and extends to the floor surface 50. Preferably, a lower 90 and an upper 92 apertures in the outer wall 30 are positioned for receiving and expelling the air flow 25 through the chase 40.

In a preferred embodiment, the apparatus further comprising plural vertically oriented layers of a sheet material 100 sandwiched between the inner and outer walls 10, 30 within the chase 40. Each of the layers 100 provides a field of spacing elements 102, such as bubbles as found in well known bubble-wrap packaging material, extending outwardly from a surface 104 of the sheet material 100 which creates open voids 106 between the layers 100 for accommodating the air flow 25, i.e., air movement vertically between the layers 100. It is noted, importantly, that with the layers 100 in place within the chase 40, air flow 25 is slowed down so that thermal transfer from the air flow 25 is improved due to the dwell time of the air flow within the layers. Please see FIG. 2. Alternately, the layers may be corrugated or otherwise made for fitting loosely in abutment so that vertical spaces exist between the layers for air flow. Such sheet layers may be made of thin plastic or metal film and the layers are preferably bonded together at a plurality of selected points. The outer wall 30 may be made of concrete blocks, vertical metal or wood studs or any other well known structure. In the case where the outer wall 30 is made up of vertical studs without an inner wall element so that only the bare studs are available for mounting the inner wall 10, mounting of the inner wall is made to the in-facing surfaces of the bare studs. In this case, a batting insulating material, as is well known, may be placed between the bare studs, with a reflective foil, as is also known, facing the chase 40. Insulation materials and reflective foils may be used to create two or more, side-by-side vertical spaces for air flow.

The hanging means 20 is preferably a plurality of hook shaped struts 110 resting within a corresponding plurality of bracket ridges 120. The struts 110 may be mounted on either the inner 10 or the outer 30 walls, with the bracket ridges 120 being mounted on the alternate element, i.e., the outer 30 or inner 10 walls respectively.

Figure 3:
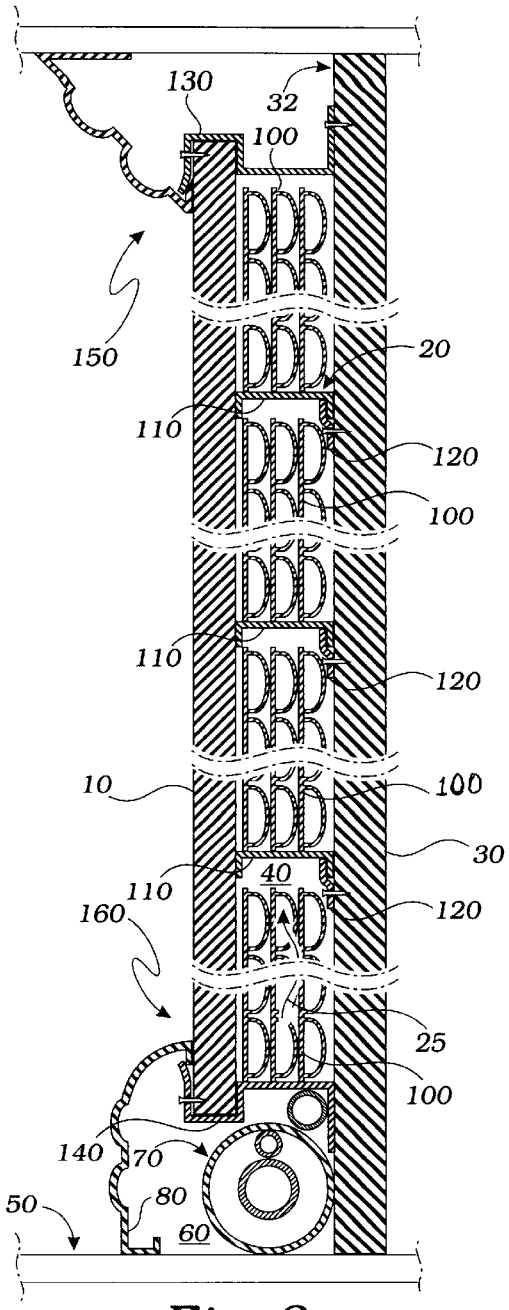
FIG. 3 is an enlarged sectional view thereof.

The apparatus preferably further comprises a top strip 130 and a bottom strip 140 which act to seal the upper 150 and lower 160 ends of the chase 40, as seen in FIG. 3.

The utility conduits 70 typically comprise any of cold water pipes, hot water pipes, insulated hot water pipes with or without water return conduits, vacuum conductors, and heating, cooling and ventilation conduits, i.e., means for moving the fluids common to services within buildings and for controlling the environment. Clearly, any such elements may be utilized within the space below the chase 40 and these may be mounted with hangers well known in the art, or by supports, also well known in the art. Please refer to the Weber et al reference, U.S. Pat. No. 2,487,287.

The apparatus preferably further comprises an air moving means 170, such as a fan or blower of any type well known in the art, whereby the device is positioned, as shown in FIG. 1, relative to at least one of the lower and upper apertures 90, 92 for urging the air flow 25 through the chase 40. An air conditioning means 180, such as a heat pump, cooler, filters and other known conditioners is preferably positioned relative to at least one of the lower and upper apertures 90, 92 for conditioning the air flow 25 through the chase 40. In this manner, the air within the chase 40 may have, or may be made to have, a significant temperature gradient relative to the air temperature within the building structure 5. In this case, the surface 11 of the interior wall 10 that is common to the interior space 6 of the building structure 5 may receive or emit heat so as to draw heat from the interior space 6 or to deliver heat into the interior space 6. Thus, by providing air flow 25 within the chase 40, temperature control within the building structure 5 is enabled.

Figure 2:
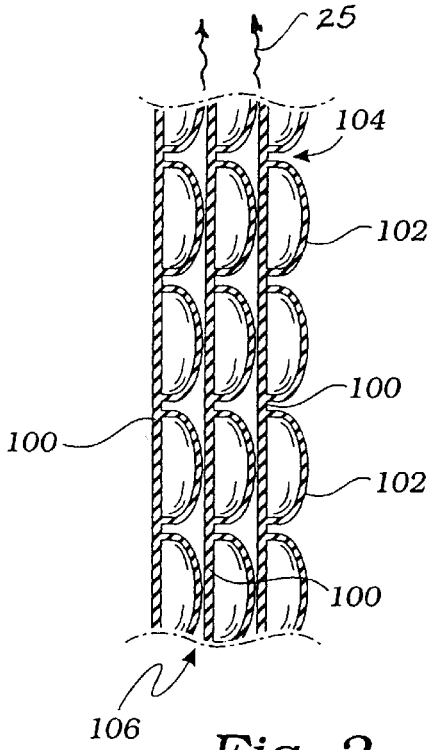
FIG. 2 is an enlarged sectional view of stacked layers thereof.
Figure 4:
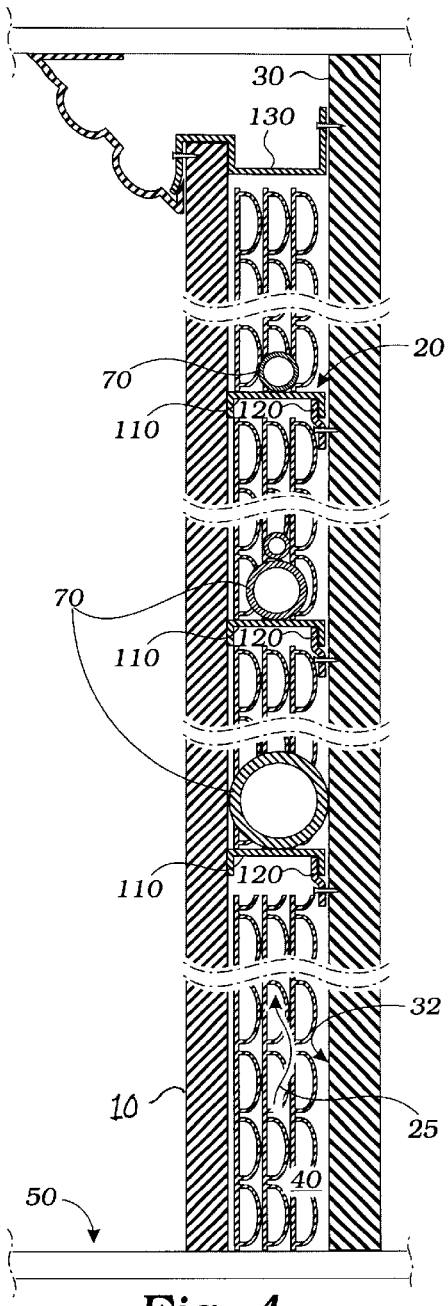
FIG. 4 is similar to FIG. 3 showing an alternate embodiment thereof.

In alternate embodiments such as shown in FIG. 4, at least one of the utility conduits 70 runs within the chase 40 supported by the hanging means 20, and the inner wall may, or may not extend to the floor surface 50 as shown in FIG. 2.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A utility distribution apparatus comprising in combination: a building structure having an outer walk an inner wall removably mounted by a means for hanging from the outer wall within the building structure; the inner and outer walls creating a chase therebetween for air flow; a floor surface forming a generally closed corner with the outer wall, the inner wall spaced apart from, and above the floor; at least one horizontally oriented utility conduit supported from at least one of the floor surface and the outer wall and positioned below the chase, adjacent the outer wall within the closed corner; a utility cover fixed to the inner wall and extending to the floor surface; a lower and an upper aperture in the outer wall positioned for receiving and expelling an air flow through the chase.

2. The apparatus of claim 1 further comprising plural vertical layers of a sheet material sandwiched between the inner and outer walls within the chase, each of the layers providing a field of spacing elements extending outwardly from a surface of the sheet material and creating open voids between the layers for accommodating the air flow.

3. The apparatus of claim 1 wherein the hanging means is a plurality of hook shaped struts resting within a corresponding plurality of bracket ridges.

4. The apparatus of claim 1 further comprising a top strip and a bottom strip, the strips extensive for sealing upper and lower ends of the chase.

5. The apparatus of claim 1 wherein the at least one utility conduit comprises at least one of a cold water pipe, a hot water pipe, an insulated hot water pipe, an insulated hot water pipe with water return conduit, a vacuum conductor, and heating, cooling and ventilation conduits.

6. The apparatus of claim 1 further comprising an air moving means positioned relative to at least one of the lower and upper apertures for urging the air flow through the chase.

7. The apparatus of claim 6 further comprising an air conditioning means positioned relative to at least one of the lower and upper apertures for conditioning the air flow through the chase.

8. A utility distribution apparatus comprising in combination: a building structure having on outer wall; an inner wall removably mounted by a means for hanging from the outer wall within the building structure; the inner and outer walls creating a chase therebetween for air flow; at least one horizontally oriented utility conduit supported on the hanging means, a lower and an upper aperture in the outer wall positioned for receiving and expelling an air flow through the chase; plural vertical layers of a sheet material sandwiched between the inner and outer walls within the chase, each of the layers providing a field of spacing elements extending outwardly from a surface of the sheet material and creating open voids between the layers for accommodating the air flow.

9. The apparatus of claim 8 wherein the hanging means is a plurality of hook shaped struts resting within a corresponding plurality of bracket ridges.

10. The apparatus of claim 8 further comprising a top strip and a bottom strip, the strips extensive for sealing upper and lower ends of the chase.

11. The apparatus of claim 8 wherein the at least one utility conduit comprises at least one of a cold water pipe, a hot water pipe, an insulated hot water pipe, an insulated hot water pipe with water return conduit, a vacuum conductor, and heating, cooling and ventilation conduits.

12. The apparatus of claim 8 further comprising an air moving means positioned relative to at least one of the lower and upper apertures for urging the air flow through the chase.

13. The apparatus of claim 12 further comprising an air conditioning means positioned relative to at least one of the lower and upper apertures for conditioning the air flow through the chase.

* * * * *